US005201144A

United States Patent [19]

Krajenke

[11] Patent Number: 5,201,144

[45] Date of Patent: Apr. 13, 1993

[54] ECCENTRICALLY LOCATED APERTURE IN A CAM SLIDER FOR WINDOW REGULATOR

[75] Inventor: Gary W. Krajenke, Warren, Mich.

[73] Assignee: General Motors Corporation, Detroit, Mich.

[21] Appl. No.: 944,613

[22] Filed: Sep. 14, 1992

[51] Int. Cl.[5] ..... E05F 11/44

[52] U.S. Cl. ..... 49/351; 49/375

[58] Field of Search ..... 49/351, 350, 349, 375, 49/250, 260

[56] References Cited

U.S. PATENT DOCUMENTS

| | | | |
|---|---|---|---|
| 3,888,047 | 6/1975 | Chikaraishi | 49/351 |
| 4,825,594 | 5/1989 | Escaravage | 49/351 |
| 4,829,630 | 5/1989 | Church et al. | 16/93 R |
| 4,882,805 | 11/1989 | Campbell et al. | 16/93 R |
| 4,924,627 | 5/1990 | Lam et al. | 49/351 |
| 4,991,351 | 2/1991 | Bertolini | 49/351 |
| 5,101,596 | 4/1992 | Moore | 49/349 X |

*Primary Examiner*—Philip C. Kannan
*Attorney, Agent, or Firm*—Raymond I. Bruttomesso, Jr.

[57] ABSTRACT

A vehicle door has a window raised and lowered by a window regulator mechanism in which a window regulator arm is coupled to a channel by a slider mounted on the arm by a swivel and slideably engaging the channel. The slider has a first pair of spaced apart opposed side surfaces, a second pair of spaced apart opposed side surfaces, and a square surface bounded by the side surfaces and having an eccentrically located mounting means for receiving the swivel. Selecting and locating one of the pairs of side surfaces for slideable engagement with the channel, slideably vertically locates the swivel in the channel and determines a specific vertical position of the swivel in the channel. The slider rotates to another orientation relative to the channel prior to installation in the channel and then locating the slider in the channel results in a different specific vertical position of the swivel in the channel. The vertical position of the swivel adjust the closed position of the window.

3 Claims, 2 Drawing Sheets

ECCENTRICALLY LOCATED APERTURE IN A CAM SLIDER FOR WINDOW REGULATOR

BACKGROUND OF THE INVENTION

1. Field of the Invention

This invention relates to a window regulator and more particularly to a cam slider having an eccentrically located aperture for adjusting in set increments the closed position of a window.

2. Description of the Relevant Art

It is known to have a window that is raised and lowered in a door by a window regulator. The window regulator has a pair of arms pivotably connected to each other. One end of each of the arms slideably engages a sash channel that carries the window glass. The other end of one of the arms has a sector which engages a gear which is driven either manually or electrically thereby raising and lowering the one end of the arm and the window glass. The other end of the other arm has a slider or cam that slides in a channel to guide the movement of the window regulator and the window glass.

It is also known to have an adjustment mechanism as part of the window regulator system to allow for adjustment, during assembly, of the raised or closed position of the window glass. One method is to have the channel, which receives the slider of the window regulator, be adjustable relative to the door by means of the channel being pivotably mounted to the inner door at one end and the other end being vertically adjustably mounted in a slot in the inner door.

It would be desirable to have an adjustable window regulator system that allows for adjustability in set increments, during assembly, of the closed position of the window glass and the increments are achieved by rotating a slider prior to installation in a channel.

SUMMARY OF THE INVENTION

This invention provides a vehicle door having a window raised and lowered by a window regulator mechanism in which a window regulator arm is coupled to a channel by a slider mounted on the arm by a swivel and the slider slideably engaging the channel. The slider has a first pair of spaced apart opposed side surfaces, a second pair of spaced apart opposed side surfaces and a square surface bounded by the side surfaces and having an eccentrically located aperture for receiving the swivel. Selecting and locating one of the pairs of side surfaces for slideable engagement with the channel, slideably vertically locates the swivel in the channel and determines a specific vertical position of the swivel in the channel. The slider rotates to another orientation relative to the channel prior to installation in the channel and then locating the slider in the channel results in a different specific vertical position of the swivel in the channel. The vertical position of the swivel adjusts the closed position of the window.

One object, feature and provision of the slider is an eccentrically located mounting aperture that is four distinct distances from the four side surfaces in order that selecting and locating one of the pair of side surfaces for slideable engagement with the channel determines a specific vertical position of the swivel in the channel and selecting another slider orientation relative to the channel prior to installing in the channel and then locating the slider in the channel result in a different specific vertical position of the swivel in the channel.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
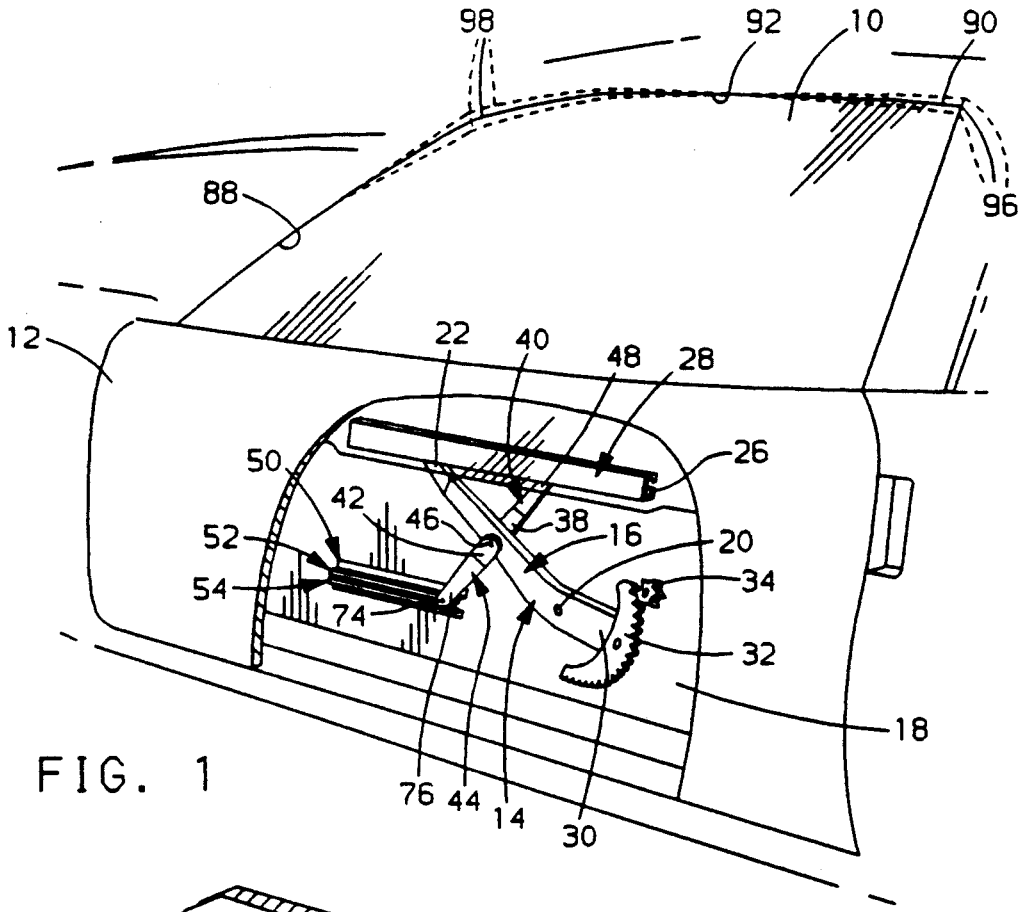
FIG. 1 is a perspective view of a vehicle door broken out to show an adjustable window regulator.

Referring to FIG. 1, a window glass 10 of a vehicle door 12 is moved up and down by an adjustable window regulator 14. The window regulator 14 has a lift arm 16 pivotally mounted to a door inner panel 18 by a pivot 20. A first end 22 of the lift arm 16 carries a slide, not shown, which is slideably retained in a regulator channel 26 of a sash channel 28 and the sash channel 28 attaches to the window 10. A second end 30 of the lift arm 16, closer in proximity to the pivot 20, has a sector gear 32 which engages a pinion gear 34. The pinion gear 34 is operated by an electric motor or hand crank, not shown. Rotation of the lift arm 16 about the pivot 20 by the pinion gear 34 will raise and lower the first end 22 and the window 10.

A first end 38 of a first regulator arm 40 and a first end 42 of a second regulator arm 44 are pivotably connected to the lift arm 16 at a point 46. The arms 40 and 44 stabilize the movement of the lift arm 16. A second end 48 of the first regulator arm 40 is connected to the sash channel 28 in an identical manner as the first end 22 of the lift arm 16.

Figure 2:
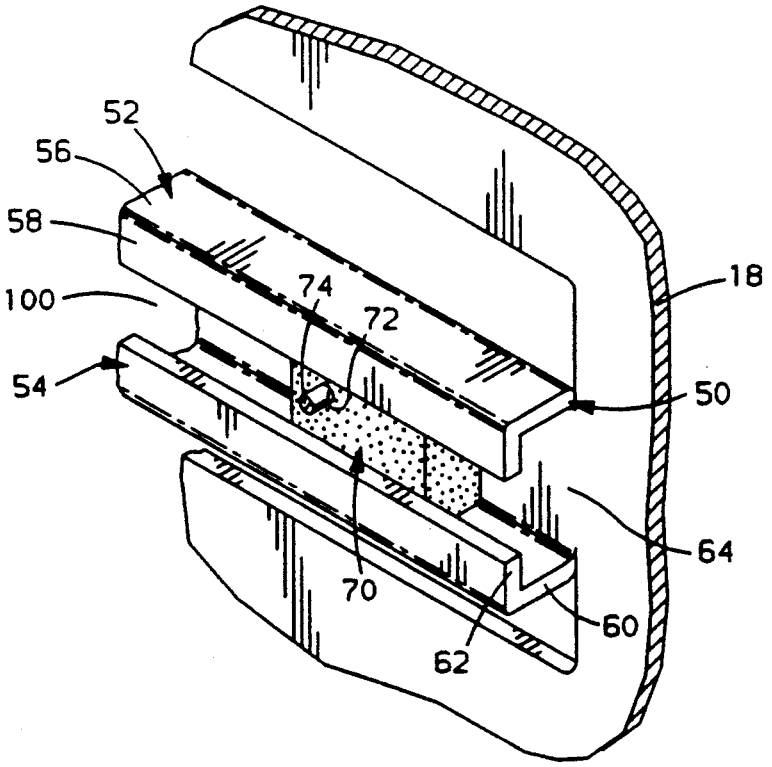
FIG. 2 is a perspective view of a broken out section of the cam channel.

Referring to FIGS. 1 and 2, a cam channel 50 is formed out of the door inner panel 18 by lancing out an upper tab 52 and a lower tab 54. The upper tab 52 is folded over to form an upper sliding wall 56 and an upper outer retaining wall 58. The lower tab 54 is folded over to form a lower sliding wall 60 and a lower outer retaining wall 62. The door inner panel 18, located between the tabs 52 and 54, acts as an inner retaining wall 64. A cam guide or slider 70 is slideably received in the cam channel 50 and has an aperture 72 for receiving a spherical end of a ball stud or swivel 74. The other end of the ball stud 74 is secured to a second end 76 of the second regulator 44 so that the second end 76 of the second regulator arm 44 is slideably and pivotably connected to the cam channel 50 and the door inner panel 18.

Referring to FIGS. 2 and 3A through 3D, the slider 70 is generally a rectangular box shape and has a square front surface 78. The aperture 72 for receiving the ball stud 74 is eccentrically located on the square front mounting surface 78. The square front surface 78 is bounded by four side surfaces 80, 82, 84 and 86. Referring to FIGS. 3A through 3D, the aperture 72, for receiving the ball stud, is spaced "A" from side surface 80, "B" from side surface 82, "C" from side surface 86 and "D" from side surface 84. "A", "B", "C" and "D" are four distinct distances so that the aperture 74 is four distinct distances from the side surfaces 80, 82, 84 and 86.

Referring to FIG. 1, the vertical location of the second end 76 of the second regulator arm 44 affects the position of the window 10 in a window opening 88, including the cant of an upper edge 90 of the window 10 as compared to an upper edge 92 of the window opening 88, by changing the geometry of the window regulator 14 relative to where the window regulator 14 is fixed to the door inner panel 18 (i.e., the slider 70 and the pivot 20).

Figure 3A:
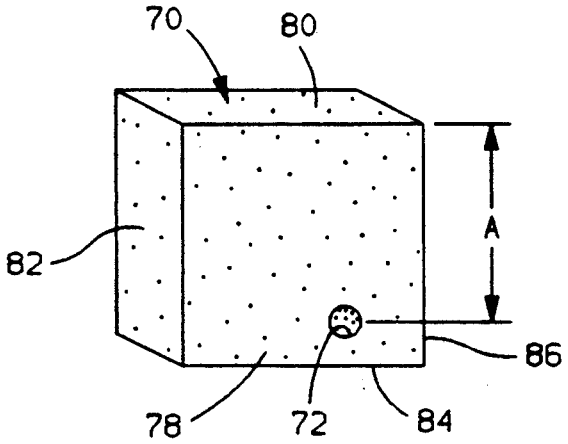
FIGS. 3A through 3D are oblique perspective views of the slider rotated to four positions so that the aperture is spaced four distinct distances from the upper side surface.
Figure 3B:
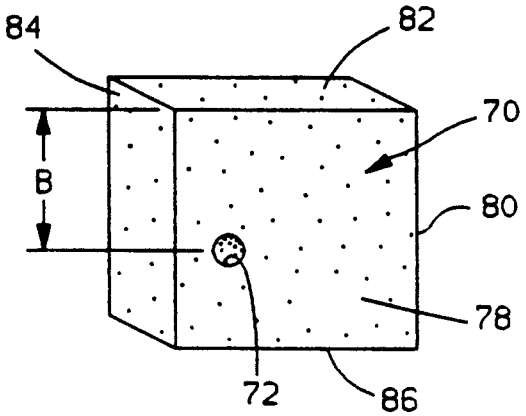

Referring to FIGS. 1, 2 and 3B, the slider 70 is located in the cam channel 50 so that one of the pair of side surfaces 82 and 86 slideably engages the sliding walls 56 and 60 of the cam channel 50, and more specifically side surface 82 engages the upper sliding wall 56. The aperture 72 is spaced "B" from the upper sliding wall 56 so that the second end 76 of the second regulator arm 44 is slideably vertically located in the cam channel 50 to define a specified closed position of the window regulator 14 and the window 10.

If it is determined that the window 10 needs to be canted differently to achieve a different specific closed position of the window regulator 14 and the window 10 in the door 12, another orientation is selected and the slider 70 is rotated 90° or 180° prior to installing in the cam channel 50. Referring to FIGS. 1 and 3A, when the slider 70 is located in the cam channel 50 so that the other pair of side surfaces 80 and 84 slideably engages the sliding walls 56 and 60 of the cam channel 50 and more specifically side surface 80 engages the upper sliding wall 56, the aperture 72 is spaced "A" from the upper sliding wall 56 to slideably vertically locate the second end 76 of the second regulator arm 44 in the cam channel 50. A rear upper corner 96 of the window 10 is canted upward as compared to the closed position when the slider is orientated in the position shown in FIG. 3B.

Figure 3C:
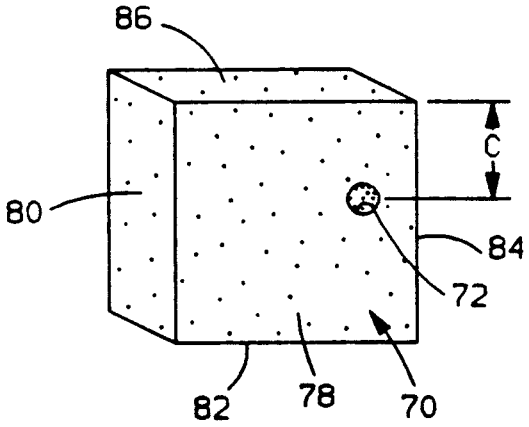
Figure 3D:
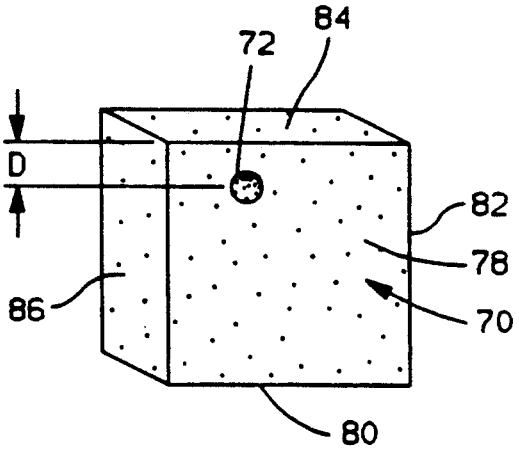

Referring to FIGS. 1, 2 and 3D, if the window 10 needs to be canted in the other directions, the slider 70 is rotated prior to installation in the cam channel 50 so that the side surface 84 slideably engages the upper sliding wall 56 of the cam channel 50. The aperture 72 is spaced "D" from the upper sliding wall 56 to slideably vertically locate the second end 76 of the second regulator arm 44 in the cam channel 50, and the rear upper corner 96 of the window 10 is lowered downward, and a front upper corner 98 is raised upward as compared to the closed position when this slider is orientated in the position shown in FIG. 3B.

Referring to FIG. 3C, the slider 70 installed in the cam channel 50 so that the side surface 86 engaging the upper sliding wall 56 spaces the aperture 72 the distance "C" from the upper sliding wall 56 and positions the window 10 in a position between that achieved by installing the slider 70 in the cam channel 50 when in the positions shown in FIGS. 3B and 3D. Referring to FIG. 2, the distance between the aperture 72 and the side surfaces 80, 82, 84 and 86 must be of such a distance to allow the ball stud 74 to extend through an opening 100 between the upper outer retaining wall 58 and lower outer retaining wall 62.

While an embodiment of the present invention has been explained, various modifications within the spirit and scope of the following claims will be readily apparent to those skilled in the art. For example, the slider 70 could have six or eight side surfaces so the mounting surface 78 is a regular hexagon or octagon having equal sides and equal angles; therefore, the paired sides are equally spaced apart. Rotation of the slider in 60° or 45° increments allows the aperture 72 to be adjusted vertically in smaller more numerous increments. The slider with the eccentric aperture could be received in the regulator channel 26 as compared to, or in addition to, the cam channel 50 to allow more adjustability.

The embodiments of the invention in which an exclusive property or privilege is claimed are defined as follows:

1. In a vehicle door having a window raised and lowered by a window regulator mechanism in which a window regulator arm is coupled to a channel by a slider mounted on the arm by a swivel and the slider slideably engaging the channel, the improvement comprising:

the slider having a plurality of paired, spaced apart, opposed side surfaces and a regular polygon mounting surface bounded by the side surfaces and having an eccentrically located mounting means for receiving the swivel, and selecting and locating one of the pairs of side surfaces for slideable engagement with the channel, slideably vertically locates the swivel in the channel determining a specific vertical position of the swivel in the channel, and selecting another slider orientation relative to the channel prior to installation in the channel and then slideably locating the slider in the channel results in a different specific vertical position of the swivel in the channel.

2. In a vehicle door having a window raised and lowered by a window regulator mechanism in which a window regulator arm is coupled to a channel by a slider mounted on the arm by a swivel and the slider slideably engaging the channel, the improvement comprising:

the slider having a first pair of spaced apart opposed side surfaces, a second pair of spaced apart opposed side surfaces and a square surface bounded by the side surfaces and having an eccentrically located mounting means for receiving the swivel, and selecting and locating one of the pairs of side surfaces for slideable engagement with the channel, slideably vertically locates the swivel in the channel determining a specific vertical position of the swivel in the channel and selecting another slider orientation relative to the channel prior to installation in the channel and then slideably locating the slider in the channel results in a different specific vertical position of the swivel in the channel.

3. In an adjustable window regulator mechanism for moving a window glass mounted in a vehicle door and the adjustable window regulator including a sash channel mounted to the window glass, a drive means for generating motion mounted to the door, a generally horizontal cam channel mounted to the vehicle door, and a window regulator having a lift arm and a regulator arm pivotably connected at a pivot point and the lift arm having a first end slideably carried by the sash channel, a second end engaging the drive means and a second pivot point between the second end and the first pivot point for rotatably mounting the lift arm to the door so that the drive means rotates the lift arm about the second pivot point, and the regulator arm of the window regulator having a first end slideably carried by the sash channel and a second end having a ball stud slideably carried by the cam channel thereby the regulator arm rotates relative to the lift arm as the drive means rotates the lift arm so that the window glass moves between an open position and a closed position in the vehicle door, the improvement comprising:

the horizontal cam channel fixed to the door and having a pair of spaced apart upper and lower sliding walls and a pair of spaced apart retaining walls and one of the retaining walls having an opening for receiving the ball stud of the second end of the second arm of the window regulator; and a slider of generally a rectangular box shape having a square surface bounded by a first pair of spaced apart opposed side surfaces and a second pair of spaced apart opposed side surfaces, and the square surface having an eccentrically located aperture spaced four distinct distances from the side surfaces and adapted to receive the ball stud of the second end of the second arm of the window regulator, and selecting one of the pair of side surfaces for slideably engaging the sliding walls of the cam channel and locating the slider in the cam channel so that one of the side surfaces slideably engages the upper sliding wall, slideably vertically locates the second end of the second arm in the cam channel determining a specified closed position of the window regulator and the window glass in the vehicle door, and selecting another slider orientation relative to the cam channel prior to installation in the cam channel and locating the slider in the cam channel so that another of the side surfaces slideably engages the upper sliding wall results in a different orientation of the slider in the cam channel thereby a different specific closed position of the window regulator and the window glass in the door.

* * * * *